US005100753A

United States Patent [19]

Maniar et al.

[11] Patent Number: 5,100,753

[45] Date of Patent: Mar. 31, 1992

[54] PROCESSES FOR COATED CARRIER PARTICLES

[75] Inventors: Deepak R. Maniar; Thomas J. Budny, both of Penfield, N.Y.

[73] Assignee: Xerox Corporation, Stamford, Conn.

[21] Appl. No.: 485,357

[22] Filed: Feb. 26, 1990

[51] Int. Cl.[5] ..... G03G 9/113

[52] U.S. Cl. ..... 430/137; 427/213.36; 427/216; 427/221

[58] Field of Search ..... 430/108, 137; 427/213.36, 216, 221; 428/407

[56] References Cited

U.S. PATENT DOCUMENTS

| | | | |
|---|---|---|---|
| 3,916,065 | 10/1975 | Moriconi et al. | 428/403 |
| 3,923,503 | 12/1975 | Hagenbach | 96/1 SD |
| 4,233,387 | 11/1980 | Mammino et al. | 430/137 |
| 4,297,427 | 10/1981 | Williams et al. | 430/108 |
| 4,304,830 | 12/1981 | Bolte et al. | 430/137 |
| 4,310,611 | 1/1982 | Miskinis | 430/107 |
| 4,524,120 | 6/1985 | Budny et al. | 430/137 |
| 4,725,521 | 2/1988 | Shigeta et al. | 430/108 |
| 4,791,041 | 12/1988 | Aoki et al. | 428/407 X |
| 4,935,326 | 6/1990 | Creatura et al. | 430/108 |

FOREIGN PATENT DOCUMENTS 106475 5/1987 Japan .

*Primary Examiner*—Roland Martin
*Attorney, Agent, or Firm*—E. O. Palazzo

[57] ABSTRACT

A process for the preparation of carrier particles which comprises mixing a carrier core with a first polymer; adding to the aforementioned mixture a second polymer not in close proximity in the triboelectric series to the first polymer; and heating the components for a period of time until the first and second polymer fuse to the core.

27 Claims, No Drawings

PROCESSES FOR COATED CARRIER PARTICLES

BACKGROUND OF THE INVENTION

This invention is generally directed to processes for the preparation of carrier particles, and more specifically, the present invention relates to a sequential addition process for the preparation of coated carrier particles. In one embodiment of the present invention the carrier particles are prepared by the mixing of a carrier core with a first polymeric carrier coating; thereafter mixing a second carrier coating; and heat treating the resulting components until the first and second polymer are fused to the core. Another embodiment of the present invention is directed to a simple economical process for the preparation of carrier particles which comprises the initial mixing of a carrier core with a first polymeric carrier coating to form a premixture; thereafter mixing a second polymeric carrier coating with the premixture wherein the second polymer is not in close proximity to the first polymer in the triboelectric series; and heat treating the resulting components in, for example, a rotary kiln until the first and second polymer are fused to the core. With the processes of the present invention there are enabled in several embodiments thereof insulating carrier particles with relatively constant conductivity parameters, and also wherein the triboelectric charge on the carrier can vary significantly depending on the coatings selected. Developer compositions comprised of the carrier particles prepared by the process of the present invention are useful in electrostatographic or electrophotographic imaging and printing systems, especially xerographic imaging processes. Additionally, developer compositions comprised of substantially insulating carrier particles prepared in accordance with the process of the present invention are useful in imaging methods wherein relatively constant conductivity parameters are desired. Furthermore, in the aforementioned imaging processes the triboelectric charge on the carrier particles can be preselected depending on the polymer composition applied to the carrier core.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, as it is these values that enable continued constant developed images of high quality and excellent resolution.

Additionally, carrier particles for use in the development of electrostatic latent images are described in many patents including, for example, U.S. Pat. No. 3,590,000. These carrier particles may comprise various cores, including steel, with a coating thereover of fluoropolymers, and terpolymers of styrene, methacrylate, and silane compounds. Efforts have focused on the attainment of coatings for carrier particles, for the purpose of improving development quality, and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there are disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are substantially constant, and moreover the triboelectric carrier values can be selected to vary significantly, for example, from less than −15 microcoulombs per gram to greater than −70 microcoulombs per gram, depending on the polymer mixture selected for affecting the coating process.

Additionally, it is known that carrier particles with a first and second coating, which coatings are not in close proximity in the triboelectric series, can be prepared by initially mixing the coatings followed by further mixing with a carrier core, and subsequently heat treating the resulting components until the polymers fuse and adhere to the carrier core. More specifically, the aforementioned processes are disclosed in U.S. Pat. No. 4,935,326 and 4,937,166, the disclosures of each of these applications being totally incorporated herein by reference, the Japanese equivalent of U.S. Ser. No. 793,042 (now abandoned) was published on May 16, 1987 as Japanese Publication 106475/87, the disclosure of which is totally incorporated herein by reference. In U.S. Pat. No. 4,937,166 there are disclosed developer compositions comprised of toner particles, and carrier particles prepared by a powder coating process; and wherein the carrier particles consist of a core with a coating thereover comprised of a mixture of polymers. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F. for a period of from about 10 minutes to about 90 minutes enabling the polymers to melt and fuse to the carrier core particles; cooling the coated carrier particles; and thereafter classifying the obtained carrier particles to a desired particle size. One disadvantage associated with the aforementioned processes resides in the need for one additional blender, which disadvantage is avoided with the processes of the present invention. Other advantages associated with the processes of the present invention include, for example, (1) avoiding the storage of premixes of the polymer selected; (2) the ratio amounts of each of the polymer selected can be instantly modified during the preparation thereof; (3) triboelectric charging properties and particularly the triboelectric charging values of the carriers can be modified and controlled depending on the mixing time of the components; (4) reduced cost in some instances in obtaining carrier particles as compared, for example, to the processes as disclosed in the patents mentioned herein; (5) any environmental adverse effects on the polymers is eliminated or minimized; and (6) dust generated with the processes of the prior art, such as illustrated by the processes in the patents, is eliminated or minimized during mixing of the first and second polymers.

In a patentability search report the following U.S. Pat. Nos. were recited: 4,233,387 directed to coating carrier particles by dry blending with resin particles including Kynar, that is polyvinylidene fluoride, and causing the polymer particles to adhere to the carrier by melt fusing; U.S. Pat. Nos. 4,297,427 and 4,725,521 which describe the concept of coating carrier particles with, for example, a mixture of Kynar and an acrylate, note the Abstract of the Disclosure of the '427 patent wherein carrier particles comprising a core have been an outer coating thereon comprising a polyblend of the first polymer possessing negative triboelectric charging characteristics with respect to the toner particles and a second polymer which possesses strong adhesive properties with respect to the core of the carrier particles; and also see the disclosure beginning at column 3, and continuing on to column 5, and note the examples of first polymer in column 4, beginning at line 26, and examples of second polymers beginning at column 4, line 36; and of background interest U.S. Pat. Nos. 3,916,065; 3,923,503; 4,304,830; 4,310,611 and 4,524,120.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses. The dual solution coating process of the present invention overcomes and/or minimizes these disadvantages, and further enables developer mixtures that are capable of generating high and useful triboelectric charging values with finely divided toner particles; and also wherein the carrier particles are of substantially constant conductivity. Additionally, there can be achieved with the process of the present invention, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with conductivities of from about $10^{-6}$ mho $(cm)^{-1}$ to $10^{-17}$ mho $(cm)^{-1}$ as determined in a magnetic brush conducting cell; and triboelectric charging values of from about a $-8$ to a $-80$ microcoulombs per gram on the carrier particles as determined by the known Faraday Cage technique. Thus, developers containing carrier particles prepared by the process of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

Other patents of interest include U.S. Pat. No. 3,939,086, which teaches steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935 and 4,434,220.

SUMMARY OF THE INVENTION

It is an object of the present invention to provide processes for the preparation of carrier particles containing a polymer mixture coating.

In another object of the present invention there are provided dry coating processes for generating carrier particles of substantially constant conductivity parameters.

In yet another object of the present invention there are provided dry coating processes for generating carrier particles of substantially constant conductivity parameters, and a wide range of preselected triboelectric charging values.

In yet a further object of the present invention there are provided carrier particles comprised of a coating with a mixture of polymers that are not in close proximity, that is, for example, a mixture of polymers from different positions in the triboelectric series, and wherein a premix of carrier core and a first polymer coating are formulated, followed by adding thereto the second polymer coating.

In still a further object of the present invention there are provided carrier particles of insulating characteristics comprised of a core with a coating thereover generated from a mixture of polymers wherein a premix of carrier core and a first polymer coating are formulated, followed by adding thereto a second polymer coating, and subsequently heating until the polymers fuse and adhere to the carrier core.

Further, in an additional object of the present invention there are provided processes for carrier particles comprised of a core with a coating thereover generated from a mixture of polymers wherein the triboelectric charging values are from about −10 microcoulombs to about −70 microcoulombs per gram at the same coating weight, wherein a premix of carrier core and a first polymer coating are formulated, followed by the sequential addition thereto of the second polymer coating, and subsequently heating until the polymers fuse and adhere to the carrier core.

In another object of the present invention there are provided methods for the development of electrostatic latent images wherein the developer mixture comprises carrier particles with a coating thereover consisting of a mixture of polymers that are not in close proximity in the triboelectric series, wherein a premix of carrier core and a first polymer coating are formulated, followed by the sequential addition thereto of the second polymer coating, and subsequently heating until the polymers fuse and adhere to the carrier core.

Also, in another object of the present invention there are provided positively charged toner compositions, or negatively charged toner compositions admixed with carrier particles with a coating thereover of a mixture of certain polymers, wherein a premix of carrier core and a first polymer coating are formulated, followed by the sequential addition thereto of the second polymer coating, and subsequently heating until the polymers fuse and adhere to the carrier core.

Moreover, in a further object for the present invention there are provided processes for the preparation of carrier particles by sequential addition method, that is, for example, wherein a carrier core is mixed with a first polymer and there is added to the aforementioned mixture a second polymer not in close proximity in the triboelectric series to the first polymer, followed by heating the components for a period of time until the first and second polymer fused the carrier core, and wherein there can be achieved independent control of the triboelectric properties of the carrier and such properties can be preselected.

These and other objects of the present invention are accomplished by providing processes for the preparation of carrier coatings and carrier particles. More specifically, the process of the present invention relates to the preparation of carrier particles wherein a premixture of a carrier core and a first polymer are formulated; thereafter a second polymeric carrier coating, which polymer is not in close proximity in the triboelectric series to the first polymer coating contained in the premix, is added to the premix; and subsequently fusing by heating until adherence of the first and second polymer to the carrier core is accomplished. In one embodiment, carrier particles can be prepared by mixing low density porous magnetic, or magnetically attractable metal core carrier particles, such as nonround Toniolo steel, with a first polymer followed by the sequential addition thereto of a second polymer coating, and subsequently heating in, for example, a rotary kiln until the polymers fuse and adhere to the carrier core, wherein the heating can be effected at, for example, a temperature of from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size, wherein there results on the carrier a polymer mixture in an effective weight percent of, for example, between about 0.05 percent and about 3 percent by weight, and preferably from about 0.70 to about 1.5 based on the weight of the carrier particles.

The process of the present invention in a specific embodiment is directed to the preparation of carrier particles by mixing carrier cores such as a steel core with a first polymer of polymethyl methacrylate for an effective period of time in this embodiment, about 15 minutes, and thereafter adding to the aforementioned mixture a second polymer not in close proximity in the triboelectric series to the first polymer, which polymer in this embodiment is comprised of Kynar, a polyvinylidine fluoride commercially available, followed by mixing for an additional period of time, for example about 15 minutes. The forementioned mixture is comprised of a steel core with a polymer mixture thereover of polymethyl methacrylate and Kynar, which mixture may be present as a continuous or noncontinuous coating in a 100:4.42:0.28 ratio, respectively, and wherein the polymer content is equivalent to a 0.7 percent coating weight of the core with the ratio of the polymethyl methacrylate and Kynar coating being 60:40 percent by weight. Subsequently, the aforementioned mixture is then processed in a known rotary kiln for the purpose of fusing the polymer mixture to the surface of the carrier core with the rotary kiln maintained at an angle of about 0.9° and at an RPM of 6 with the fusing temperature being from about 365° to 395° F. and the feed rate of the mixture being from about 400 to about 700 pounds per hour.

In a specific embodiment of the present invention, there are provided carrier particles comprised of a core with a coating thereover comprised of a mixture of a first dry polymer component and a second dry polymer component, which polymers are not in close proximity in the triboelectric series, and can have a work function value of from at least about 0.2 to about 2 wherein a premixture of a carrier core and a first polymer are formulated in a Munson mixer; thereafter a second polymeric carrier coating, which polymer is not in close proximity in the triboelectric series to the first polymer coating contained in the premix, is added to the premix; and subsequently fusing by heating until adherence of the first and second polymer to the carrier core is accomplished. In another embodiment, carrier particles can be prepared by mixing low density porous magnetic, or magnetically attractable metal core carrier particles such as steel with a first polymer in a mixer, such as a Munson MX-1 mixer, followed by the sequential addition thereto of the second polymer coating, wherein the first and second polymer are not in close proximity in the triboelectric series, and subsequently heating in, for example, a rotary kiln until the polymers fuse and adhere to the carrier core, wherein the heating can be effected at, for example, a temperature of from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired diameter particle size of, for example, from about 30 microns to about 300 microns. Therefore, the aforementioned carrier compositions can be comprised of known core materials including iron with a dry polymer coating mixture thereover. Subsequently, developer compositions can be generated by admixing the aforementioned carrier particles with a toner composition comprised of resin particles and pigment particles.

Various suitable solid core carrier materials can be selected for the processes of the present invention. Typical core properties include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes, and also wherein the carrier cores possess desirable mechanical aging characteristics. Examples of carrier cores that can be selected include iron, steel, ferrites, including nickel zinc, copper magnesium zinc, nickel berry, magnetites, nickel, and mixtures thereof. Preferred carrier cores include ferrites, sponge iron, or nonround Toniolo steel grit with an average particle size diameter of from between about 30 microns to about 200 microns.

Illustrative examples of polymer coatings selected for the process of the present invention include those that are not in close proximity in the triboelectric series. Specific examples of polymer mixtures are polyvinylidene fluoride with polyethylene; polymethyl methacrylate and copolyethylene vinylacetate; copolyvinylidene fluoride tetrafluoroethylene and polyethylene; polymethyl methacrylate and copolyethylene vinylacetate; and polymethyl methacrylate and polyvinylidenefluoride. Other related polymer mixtures not specifically mentioned herein can be selected including, for example, polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate, and the like.

With further reference to the polymer coating mixture, reference the U.S. Pat. Nos. 4,937,166 and 4,935,326 mentioned herein, the disclosure of which have been totally incorporated herein by reference, by close proximity is meant, for example, that the choice of the polymers selected are dictated by their position in the triboelectric series, therefore for example, one may select a first polymer with a significantly lower triboelectric charging value than the second polymer. For example, the triboelectric charge of a steel carrier core with a polyvinylidene fluoride coating is about −75 microcoulombs per gram. However, the same carrier, with the exception that there is selected a coating of polyethylene, has a triboelectric charging value of about −17 microcoulombs per gram. More specifically, not in close proximity refers to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science*, A. D. Jenkins, Editor, North Holland Publishing (1972), the disclosure of which is totally incorporated herein by reference.

The percentage of each polymer present in the carrier coating mixture can vary depending on the specific components selected, the coating weight and the properties desired. Generally, the coated polymer mixtures used contains from about 10 to about 90 percent of the first polymer, and from about 90 to about 10 percent by weight of the second polymer. Preferably, there are selected mixtures of polymers with from about 40 to 60 percent by weight of the first polymer, and from about 60 to 40 percent by weight of a second polymer. In one embodiment of the present invention, when a high triboelectric charging value is desired, that is exceeding −50 microcoulombs per gram, there is selected from about 90 percent by weight of the first polymer such as polyvinylidene fluoride, and 10 percent by weight of the second polymer such as polyethylene. In contrast, when a lower triboelectric charging value is required, less than about −20 microcoulombs per gram, there is selected from about 10 percent by weight of the first polymer, and 90 percent by weight of the second polymer. The coating of polymer mixtures can be continuous or noncontinuous on the carrier core and is generally present in an effective weight percent amount based on the carrier core, for example, from about 0.1 to about 5 weight percent and preferably from about 0.6 to about 3 weight percent in an embodiment of the present invention.

Also, these results, in accordance with an embodiment of the present invention, carrier particles of relatively constant conductivities from, for example, about $10^{-15}$ mho-cm$^{-1}$ to about $10^{-9}$ mho-cm$^{-1}$ at, for example, a 10 volt impact across a 0.1 inch gap containing carrier beads held in place by a magnet; and wherein the carrier particles are of a triboelectric charging value of from −15 microcoulombs per gram to −70 microcoulombs per gram, these parameters being dependent on the coatings selected, and the percentage of each of the polymers used as indicated hereinbefore.

Illustrative examples of finely divided toner resins selected for the developer compositions containing the carrier particles obtained with the processes of the present invention include polyamides, epoxies, polyurethanes, diolefins, vinyl resins and polymeric esterification products of a dicarboxylic acid and a diol comprising a diphenol, styrene acrylates, styrene methacrylates, styrene butadienes, crosslinked styrene containing copolymers, and the like. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; resins with low molecular weight waxes, about 1,000 to about 6,000, such as polypropylene and polyethylene; N-vinyl indole, N-vinyl pyrrolidene; styrene butadiene copolymers; crosslinked styrene polymers wherein, for example, divinylbenzene is the crosslinking component; mixtures thereof, especially mixtures of the aforementioned wax resin (75 weight percent) and terpolymers of styrene, methacrylate, and acrylonitrile (25 weight percent); and other similar substances.

As one preferred toner resin there can be selected the esterification products of a dicarboxylic acid and a diol comprising a diphenol, reference U.S. Pat. No. 3,590,000 the disclosure of which is totally incorporated herein by reference. Other preferred toner resins include styrene/methacrylate copolymers, styrene/-butadiene copolymers, polyester resins obtained from the reaction of bisphenol A and propylene oxide; and branched polyester resins resulting from the reaction of dimethylterephthalate, 1,3-butanediol, 1,2-propanediol and pentaerythritol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 3 percent by weight to about 20 percent by weight, based on the total weight of the toner composition, however, lesser or greater effective amounts of pigment particles can be selected.

When the pigment particles are comprised of magnetites, which are a mixture of iron oxides ($FeO.Fe_2O_3$), including those commercially available as Mapico Black, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment or colorant such as carbon black is contained therein, about 90 percent by weight of resin material is selected. Generally, however, providing the objectives of the present invention are achieved, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, carrier particles and as pigments or colorants, red, blue, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyan materials that may be used as pigments include copper tetra-4(octaecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an effective amount of from, for example, about 1 weight percent to about 15 weight percent based on the weight of the toner resin particles.

For further enhancing the positive charging characteristics of the developer compositions described herein and optional components, there can be incorporated therein or thereon charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate, reference U.S. Pat. No. 4,560,635, the disclosure of which is totally incorporated herein by reference; and other similar known charge enhancing additives. These additives are usually incorporated into the toner in an amount of from about 0.1 percent by weight to about 20 percent by weight, preferably from about 0.5 to about 5 weight percent in an embodiment of the present invention.

The toner composition can be prepared by a number of known methods including melt blending the toner resin particles, and pigment particles or colorants of the present invention followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Thereafter, the toner particles may be micronized and classified by known methods to enable, for example, toner particles with an average diameter of from about 10 to about 20 microns.

Also, the toner and developer compositions illustrated herein may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials, and the like. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with this developer composition had acceptable solids, excellent halftones and desirable line resolution with acceptable or substantially no background deposits.

With further reference to the process for generating the carrier particles illustrated herein, there is initially obtained, usually from commercial sources, the uncoated carrier core and the polymer powder mixture coating. The individual components for the coating are available, for example, from Pennwalt as 301F Kynar, Allied Chemical as Polymist B6, and other sources. Generally, these polymers are present in various proportions as mentioned hereinbefore, for example, in a ratio of 1:1, 0.1 to 0.9; and 0.5 to 0.5. The blending for the premixture formation can be accomplished by numerous known methods including, for example, a twin shell mixing apparatus. Thereafter, the second polymer is incorporated into a mixing apparatus, about 0.7 percent by weight of the powder to the core by weight in a preferred embodiment, and mixing is affected for a sufficient period of time until the polymer blend is uniformly distributed over the carrier core, and mechanically or electrostatically attached thereto. Subsequently, the resulting coated carrier particles are metered into a rotating tube furnace, which is maintained at a sufficient temperature to cause melting and fusing of the polymer blend to the carrier core.

Also, there can be obtained in accordance with the process of the present invention carrier particles with positive triboelectric charging values thereon of from about 10 to about 80 microcoulombs per gram by, for example, selecting as carrier coatings polyethylene and polymethyl methacrylates.

The following examples are being supplied to further define the present invention, it being noted that these examples are intended to illustrate and not limit the scope of the present invention. Parts and percentages are by weight unless otherwise indicated.

EXAMPLE I

Carrier particles were prepared by coating 150 pounds of a Toniolo atomized steel core, 120 microns in diameter, with 0.45 pounds of polymethyl methacrylate, PMMA, available from Soken Chemical as MP116, and 0.45 pound of polyvinylindene fluoride, available as Kynar 301F. The core and PMMA are mixed first in a MX-1 Munson mixer for 10 minutes, the mixer is inactivated, the Kynar added and mixing continued for 20 more minutes. There results an electrostatically attached uniform distribution of the Kynar/PMMA on the carrier core as determined by visual observation. The resulting carrier particles were metered into a rotating tube furnace available from Harper Company at a rate of 400 grams/minute. This furnace was maintained at a temperature of 400° F. thereby causing the polymers to melt and fuse to the core.

A developer composition was then prepared by mixing 97 grams of the above prepared carrier particles with 3 grams of a toner composition comprised of 84.5 weight percent of a mixture of resins comprised of styrene butadiene with 89 percent by weight of styrene and 11 percent by weight of butadiene (75 weight percent) and 25 weight percent of a terpolymer of styrene, n-butylmethacrylate, acrylonitrile available from Sanyo Chemical Company of Japan, 10 percent by weight of carbon black, 5 percent by weight of a polypropylene wax commercially available as 660P wax, and 0.5 weight percent of the charge enhancing additive distearyl dimethyl ammonium methyl sulfate. Thereafter, the triboelectric charge on the carrier particles was determined by the known Faraday Cage process, and there was measured on the carrier a charge of −22 microcoulombs/grams, thus the carrier was insulating. Further, the conductivity of the carrier as determined by forming a 0.1 inch long magnetic brush of the carrier particles, and measuring the conductivity by imposing a 10 volt potential across the brush, was $10^{-15}$ mho-$cm^{-1}$.

In all the Examples, the triboelectric charging values and the conductivity numbers were obtained in accordance with the aforementioned procedure.

EXAMPLE II

Carrier particles were prepared by mixing in a MX-1 Munsen mixer 150 pounds of Toniolo atomized steel core with 0.9 pound of PMMA (polymethyl methacrylate) for 15 minutes and then adding 0.6 pound of Kynar 301F to the above mixture and mixing it for 15 minutes with the above mixture. The aforementioned polymer mixture was then processed in a rotating tube furnace or a rotary kiln by repeating the process of Example I, and substantially similar results were obtained.

EXAMPLE III

The process of Example II was repeated with the exception that 30 minutes of mix time for PMMA and then 30 minutes of mix time for Kynar 301F was selected, and substantially similar results were obtained.

EXAMPLE IV

The process of Example II was repeated with the exception that 45 minutes of mix time for PMMA and then 30 minutes of mix time for Kynar 301F was selected, and substantially similar results were obtained.

EXAMPLE V

One-hundred and fifty (150) pounds of Toniolo atomized core was first mixed with 0.6 pound of PMMA for 30 minutes and the resulting mixture was then mixed with 0.9 pound of Kynar 301F for an additional 30 minutes. The aforementioned polymer mixture was then processed in a rotating tube furnace by repeating the process of Example I, and substantially similar results were obtained.

EXAMPLE VI

Eight hundred and forty (840) pounds of Toniolo atomized core was first mixed with 5.04 pounds of PMMA for 30 minutes in a Munson MX-5 mixer operating at 23 RPM. Thereafter, 3.36 pounds of Kynar 301F were added to the above mixture and the mixture resulting was blended for an additional 30 minutes. The resulting polymer mixture was then fused to the core with a rotary kiln of 16 inch diameter at 6 RPM and at an angle of 0.9° with a feed rate of 680 pounds per hour (of the mixture) and at a temperature range of 360° F. to 400° F.

For the carriers of Examples II throught VI, the breakdown voltages were from about 1,500 to 2,000 volts. Developers made with toners in accordance with Example I had a triboelectric charging value for the carrier of −16.3 microcoulombs per gram for Example III at a toner concentration of 2.8.

EXAMPLE VII

The process of Example I was repeated with the exception that the core and Kynar were first mixed, followed by the addition of the PMMA. The resulting carrier had a breakdown voltage of 350 volts.

With respect to the triboelectric numbers in microcoulombs per gram, they were determined by placing the developer materials in an 8 oz. glass jar, with 2.75 percent by weight of the toner compositions, which jar was then placed on a Red Devil Paint Shaker and agitated for 10 minutes. Subsequently, the jar was removed and samples from the jar were placed in a known tribo Faraday Cage apparatus. The blow off tribo of the carrier particles was then measured.

Toner and developer compositions were prepared by repeating the procedure of Example I with the exception that there were selected the carriers as prepared in Examples II, III, IV, V and VI, respectively, and substantially similar results were obtained.

It is believed that images of excellent quality, that is those with high resolution and substantially no background deposits, can be obtained with the aforementioned prepared toner and developer compositions when these compositions are utilized in the imaging apparatus commercially available from Xerox Corporation as the 5090 TM.

Other modifications of the present invention may occur to those skilled in the art subsequent to a review of the present application and these modifications, including equivalents thereof, are intended to be included within the scope of the present invention.

What is claimed is:

1. A process for the preparation of carrier particles which consists essentially of mixing a carrier core with a first polymer thereby forming a premixture comprised of said carrier core and first polymer; subsequently adding to the premixture a second polymer not in close proximity in the triboelectric series to the first polymer and mixing further; heating the premixture and second polymer contained therein to a temperature of between about 200° F. and about 550° F., whereby the polymer mixture melts and fuses to the carrier core particles; and subsequently cooling the resulting coated carrier particles.

2. A process in accordance with claim 1 wherein the carrier core is steel.

3. A process in accordance with claim 1 wherein the carrier core is selected from the group consisting of iron and ferrites.

4. A process in accordance with claim 1 wherein the polymer mixture selected is comprised of from about 40 percent by weight to about 60 percent by weight of the first polymer, and from about 60 percent by weight to about 40 percent by weight of the second polymer.

5. A process in accordance with claim 1 wherein the resulting carrier particles are of a conductivity of from about $10^{-6}$ mho-cm$^{-1}$ to about $10^{-17}$ mho-cm$^{-1}$.

6. A process in accordance with claim 1 wherein the triboelectric charging value of the resulting carrier particles is from about −5 microcoulombs per gram to about −80 microcoulombs per gram.

7. A process in accordance with claim 1 wherein the coating is continuous, and is present in a thickness of from about 0.2 micron to about 1.5 microns.

8. A process in accordance with claim 1 wherein the polymer mixture is heated for a period of from about 10 minutes to about 60 minutes.

9. A process in accordance with claim 1 wherein the carrier core is nickel.

10. A process in accordance with claim 1 wherein the carrier core particles have an average particle diameter of between about 30 microns and about 200 microns.

11. A process in accordance with claim 1 wherein the carrier core has a surface area of from about at least 200 cm$^2$ per gram, and to about 1,000 cm$^2$ per gram.

12. A process in accordance with claim 1 wherein the mixing time for the formation of the premix is from about 30 to about 60 minutes.

13. A process in accordance with claim 1 wherein mixing of the components is accomplished in a Munson mixer.

14. A process in accordance with claim 1 wherein heating is accomplished in a rotary kiln.

15. A process in accordance with claim 1 wherein the core is selected from the group consisting of iron, ferrites, steel and nickel.

16. A process for the preparation of carrier particles with substantially stable conductivity parameters which consists essentially of (1) mixing carrier cores with from about 10 to about 90 percent by weight of a first polymer thereby forming a premixture of said carrier cores and first polymer; (2) adding to the aforementioned premixture a second polymer in an amount of from about 90 to about 10 percent by weight and mixing further; (3) heating the mixture of carrier core particles and polymers to a temperature of between about 200° F. and about 550° F., whereby the polymer mixture melts and fuses to the carrier core particles; and (4) thereafter cooling the resulting coated carrier particles, wherein the first polymer and second polymer are not in close proximity thereto in the triboelectric series.

17. A process in accordance with claim 16 wherein the polymer mixture selected is comprised of from about 40 percent by weight to about 60 percent by weight of the first polymer, and from about 60 percent by weight to about 40 percent by weight of the second polymer.

18. A process in accordance with claim 16 wherein the components are heated for a period of from about 10 minutes to about 90 minutes.

19. A process in accordance with claim 16 wherein subsequent to classification the carrier core particles have an average particle diameter of between about 30 microns and about 200 microns.

20. A process in accordance with claim 1 wherein the difference in electronic work function values between the first and second polymer is at least 0.2 electron volts.

21. A process in accordance with claim 1 wherein the first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; polyvinyl acetate and polymethyl methacrylate; and polyvinylidene fluoride and polymethyl methacrylate.

22. A process in accordance with claim 20 wherein the first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; polyvinyl acetate and polymethyl methacrylate; and polyvinylidene fluoride and polymethyl methacrylate.

23. A process in accordance with claim 16 wherein the first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; polyvinyl acetate and polymethyl methacrylate; and polyvinylidene fluoride and polymethyl methacrylate.

24. A process in accordance with claim 11 wherein the first and second polymers are selected from the group consisting of polyvinylidene fluoride and polyethylene; polymethyl methacrylate and copolyethylene vinylacetate; copolyvinylidene fluoride tetrafluoroethylene and polyethylene; polymethyl methacrylate and copolyethylene vinylacetate; and polymethyl methacrylate and polyvinylidene fluoride.

25. A process in accordance with claim 12 wherein the polymer coating weight is from about 0.1 to about 5 weight percent.

26. A process in accordance with claim 12 wherein the first and second polymers are selected from the group consisting of polyvinylidene fluoride and polyethylene; polymethyl methacrylate and copolyethylene vinylacetate; copolyvinylidene fluoride tetrafluoroethylene and polyethylene; polymethyl methacrylate and copolyethylene vinylacetate; and polymethyl methacrylate and polyvinylidene fluoride.

27. A process in accordance with claim 21 wherein the first and second polymers are selected from the group consisting of polyvinylidene fluoride and polyethylene; polymethyl methacrylate and copolyethylene vinylacetate; copolyvinylidene fluoride tetrafluoroethylene and polyethylene; polymethyl methacrylate and copolyethylene vinylacetate; and polymethyl methacrylate and polyvinylidene fluoride.

* * * * *